US007156539B2

(12) United States Patent
Cronk

(10) Patent No.: US 7,156,539 B2
(45) Date of Patent: Jan. 2, 2007

(54) ADJUSTABLE REFLECTOR DEVICE

(76) Inventor: Paul Andrew Cronk, Harbord (AU)

( * ) Notice: Subject to any disclaimer, the term of this patent is extended or adjusted under 35 U.S.C. 154(b) by 97 days.

(21) Appl. No.: 10/922,503

(22) Filed: Aug. 20, 2004

(65) Prior Publication Data

US 2005/0057932 A1 Mar. 17, 2005

Related U.S. Application Data

(63) Continuation-in-part of application No. 09/548,862, filed on Apr. 13, 2000, now Pat. No. 6,783,263, which is a continuation-in-part of application No. 08/952, 628, filed on Mar. 10, 1998, now Pat. No. 6,053,624.

(51) Int. Cl.
*F21S 8/04* (2006.01)

(52) U.S. Cl. ..... 362/297; 362/278; 362/346; 362/347; 362/283; 362/306; 362/320

(58) Field of Classification Search ..... 362/241, 362/221, 225, 260, 341, 347, 264, 344–345, 362/285, 294, 297, 278, 306, 346, 281, 283, 362/280, 282, 320, 352, 449, 450
See application file for complete search history.

(56) References Cited

U.S. PATENT DOCUMENTS 3,099,403 A 7/1963 Strawick
4,007,365 A * 2/1977 Stempfle et al. ..... 362/283
4,174,533 A 11/1979 Barthes et al.
4,796,168 A 1/1989 Peterson
5,249,110 A 9/1993 Russello et al.
5,274,533 A * 12/1993 Neary et al. ..... 362/225
5,570,947 A 11/1996 Felland
5,615,943 A 4/1997 Coldren
6,053,624 A 4/2000 Cronk
6,783,263 B1 8/2004 Cronk

FOREIGN PATENT DOCUMENTS

DE 2314935 3/1974
GB 353170 7/1931
GB 2232476 A 12/1990

* cited by examiner

*Primary Examiner*—Sandra O'Shea
*Assistant Examiner*—Sharon Payne
(74) *Attorney, Agent, or Firm*—John F. McKenna; Cesare & McKenna, LLP

(57) ABSTRACT

A reflector device for a luminaire, said reflector device comprising a pair of resilient sheets positioned one to either side of a spine in the manner of the pages of a book, said sheets when in an unbiased condition lying substantially in two planes intersecting at an obtuse angle and when flexed and retained against the bias of their normal resilience having a doubly arched configuration which forms a reflective surface.

26 Claims, 5 Drawing Sheets

ADJUSTABLE REFLECTOR DEVICE

RELATED APPLICATIONS

This application is a continuation-in-part of Ser. No. 09/548,862, filed Apr. 13, 2000, now U.S. Pat. No. 6,783,263, which is a continuation-in-part of Ser. No. 08/952,628, filed Mar. 10, 1998, now U.S. Pat. No. 6,053,624.

BACKGROUND OF THE INVENTION

This invention relates to improvements in devices for reflecting light emitted by artificial sources.

DESCRIPTION OF THE PRIOR ART

Modem industrial requirements for artificial lighting are extensive, varied, and constantly expanding.

Many types of reflector devices associated with artificial illumination of industrial spaces are currently known, but these all require that a fixed shape and/or a is fixed lamp mounting position within that shape be precisely specified to create optimal light distribution for a particular purpose. For example, a 'chinaman hat' reflector might commonly be used in a situation where a wide, uniform spread of light is required. In this case, the spreading of light is largely dependent on the fixed internal angle of the cone shaped 'chinaman hat' reflector. The uniformity of light emitted is therefore largely dependent on the non-adjustable lamp positioning within that reflector. These known devices have the disadvantage that their rigid, non-adjustable, designs limit their efficient use to a relatively small range of applications.

The present invention seeks to provide an adjustable light reflecting device which overcomes or at least ameliorates the disadvantages of the prior art.

SUMMARY OF THE INVENTION

In accordance with the present invention there is disclosed a reflector device for a luminaire, said reflector device comprising a pair of resilient sheets positioned one to either side of a spine in the manner of the pages of a book, said sheets when in an unbiased condition lying substantially in two planes intersecting at an obtuse angle and when flexed and retained against the bias of their normal resilience having a doubly arched configuration which forms a reflective surface.

Preferably, the sheet members are retained against the basis of their normal resilience by a retaining means linked between the sheet members. Also preferably, the retaining means is a chain, threaded rod, strip or wire or like filamentary means. Preferably the retaining means is adjustable in length, for example by nuts on a threaded rod, a wire being bent to length, a series of apertures in a strip, or a telescopic member.

In a preferred form, a lamp holder is adapted to be attached to the reflector device by an optionally adjustable attachment means to form a luminaire.

In a preferred embodiment a heat shield is provided for the luminaire.

Preferably, the heat shield is U-shaped or V-shaped and secured to the side of the lamp holder opposite the reflector device, and is preferably perforated.

In a preferred form, each of the sheets members are separately fabricated and then secured together to form the reflector device.

Preferably, each of the sheet members is substantially rectangularly shaped and is provided with a skirt adjacent an edge of the respective sheet and which protrudes out of the plane of the rectangle. Thus, to form the reflector device, the skirt of the first sheet is connected to the edge of the second sheet, and the skirt of the second sheet is connected to the edge of the first sheet.

Also preferably, the skirts and the edges are interconnected by bolts, welds or the like.

BRIEF DESCRIPTION OF THE DRAWINGS

The present invention will become more fully understood from the following description of preferred but non-limiting embodiments thereof, described in connection with the accompanying drawings, wherein.

DETAILED DESCRIPTION OF THE PREFERRED EMBODIMENT

Throughout the drawings, like numerals will be utilized to represent similar features, except where expressly otherwise indicated.

Figure 1:
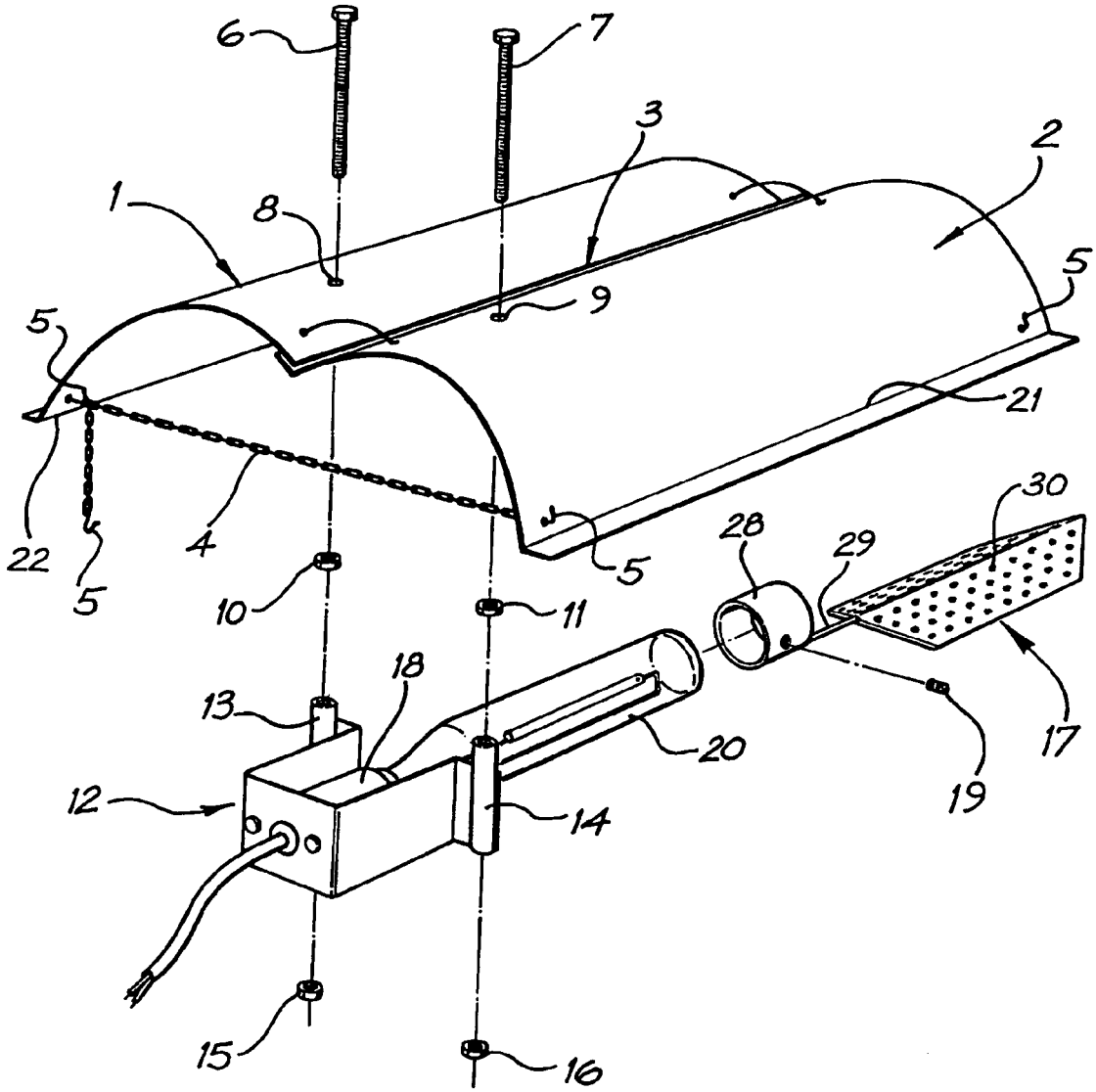
FIG. 1 shows an exploded view of one example of a luminaire including an adjustable reflector device according to the preferred embodiment of the present invention.

Also, throughout the specification, the term "a doubly arched configuration" is utilised to describe the shape of the reflector device when it is in its flexed position, and retained against the bias of its normal resilience, as for example, shown in FIG. 1 of the drawings. In considering this definition, it should be appreciated that any size, shape or width of arch whether of parabolic or similarly shaped curve should be considered to fall within the scope of this definition.

Briefly, an adjustable light reflector device is disclosed comprising a pair of resilient reflective sheets, flexed to form a double arch or double parabolic shape. The sheets are held in place against their resiliency by adjustable retainers located at each side of the reflector device. An independently adjustable lamp mount attaches to the sheets to form a luminaire. A slide on V-shaped perforated heat shield is preferably attached to the lamp fitting.

Referring to FIG. 1, it can be seen that the adjustable reflector device according to the preferred embodiment of this invention is formed by two resilient sheet members 1 and 2. Each sheet member 1, 2 preferably has two protruding skirts which extend parallel with the longer edges of the sheet member. The sheet members 1,2 are substantially rectangularly shaped and are detachably joined about a spine portion 3. Then they are flexed back against their normal resilience to produce a doubly arched shape, as shown, such that one edge and the associated skirt of one sheet member neatly overlaps the corresponding skirt and edge of the other.

The sheets are then flexed back to achieve a reflective doubly arched "m" shape. The sheet members 1, 2 may be made of any suitable material such as painted or powder coated metal, bare metal, fibreglass, or plastic. The pair of sheet members 1,2 could be integrally manufactured in a one piece construction—as opposed to being separately formed as illustrated. These sheets are adjustably secured by a pair of chain retainers 4 each having a pair of hooks 5 (only one retainer being shown because of the orientation). The retaining means may be a chain, threaded rod, strip, wire or like filament. The retaining means is optionally adjustable in effective length, for example by nuts on a threaded rod, a wire being bent to length, a series of apertures in a strip, or a telescopic member.

A pair of threaded bolts 6 and 7 pass through holes 8 and 9 in the top of the assembled skin and are secured by nuts 10 and 11. A lamp mount 12 attaches to bolts 6 and 7 through holes 13 and 14 and is adjustably secured by attaching nuts 15 and 16. The lamp mount comprises a sliding plate that adjusts along the pair of threaded bolts 6,7. Nuts 10,11 are used to secure bolts 6,7 while nuts 15,16 provide a means of adjustment for the lamp mount 12. The lamp mount 12 may be designed in any fashion, adjustable or non-adjustable, so long as it does not substantially inhibit flexibility of the sheet members 1,2 when attached thereto.

A V-shaped perforated heat shield 17 slides onto a lamp holder 18 and is secured to the underside thereof by a grub screw 19. The heat shield 17 preferably extends along at least part of the element of the lamp, and is attached via a slender arm 29 to a piece of cylindrical tube 28 which slides onto the lamp holder 18 and is secured with the grub screw 19. The heat shield 17 may be perforated with any number of holes 30 of any size or shape and is preferably substantially V-shaped. Depending upon the sharpness or roundness of the central ridge of the heat shield 17, the term U-shaped can also be applied to the heat shield 17. For example a 20 mm radius at the ridge is preferred. The heat shield 17 is able to be attached to the luminaire by any method capable of securing the heat shield 17 substantially parallel to the under side of the lamp 20.

Figure 2:
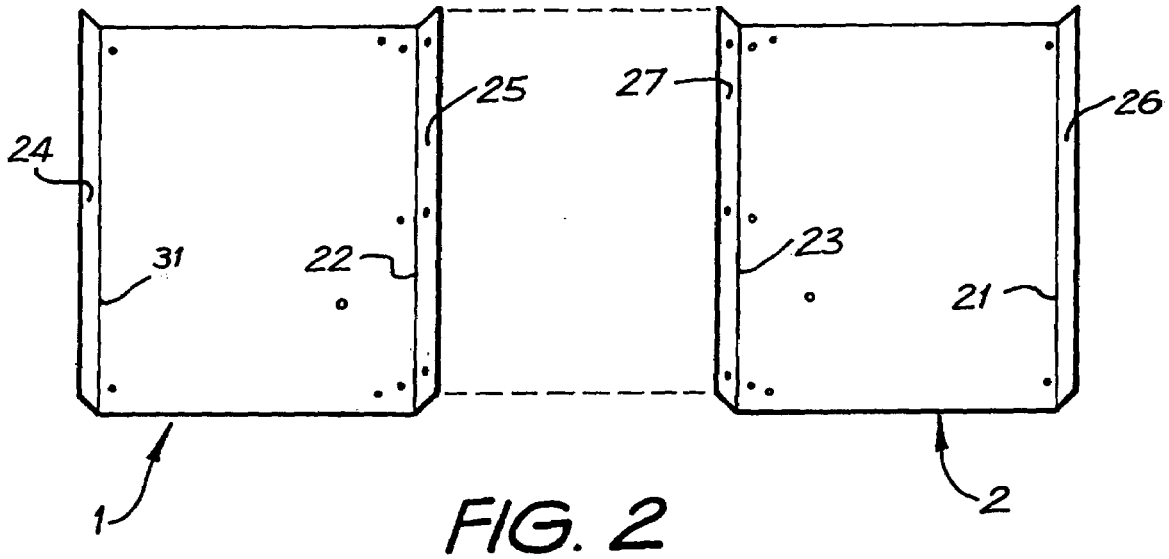
FIG. 2 shows a disassembled view of the skin of the reflector device, depicting the protruding skirts, present on the sheet members.

Referring to FIG. 2 it can be seen that sheet members 1 and 2 which comprise the reflector, each have two longitudinally extending folds or bends 31, 22 and 21, 23 which create corresponding skirts 24, 25, 26 and 27. The angle of each fold is preferably in the range of about 120° to about 140°. The folds or bends produce rigidity and strength in the flexed and retained reflector. The resilient reflector may comprise one or any number of sheet members and any necessary reinforcing members fashioned so as to approximate the predefined shape and conditions required for formation of a doubly arched configuration.

Figure 3:
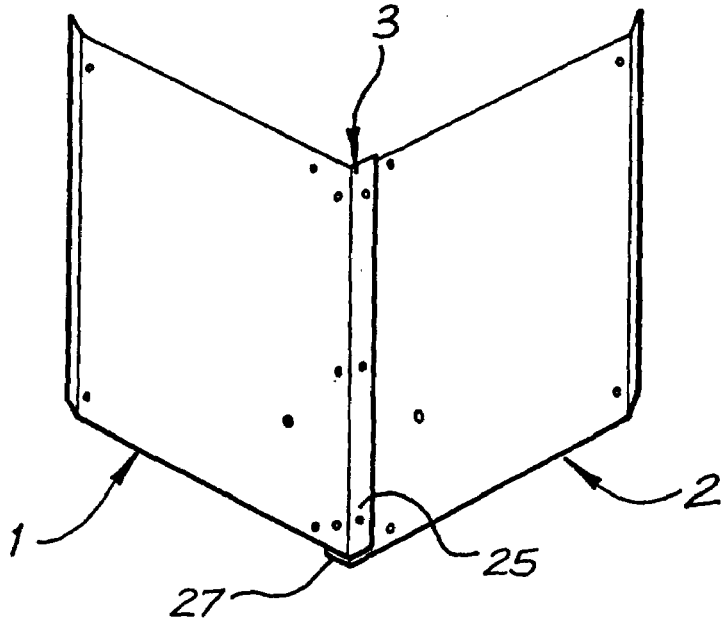
FIG. 3 shows an assembled view of the sheets prior to flexing, FIG. 4 repeats FIG. 3 but with a plane indicated in phantom.
Figure 4:
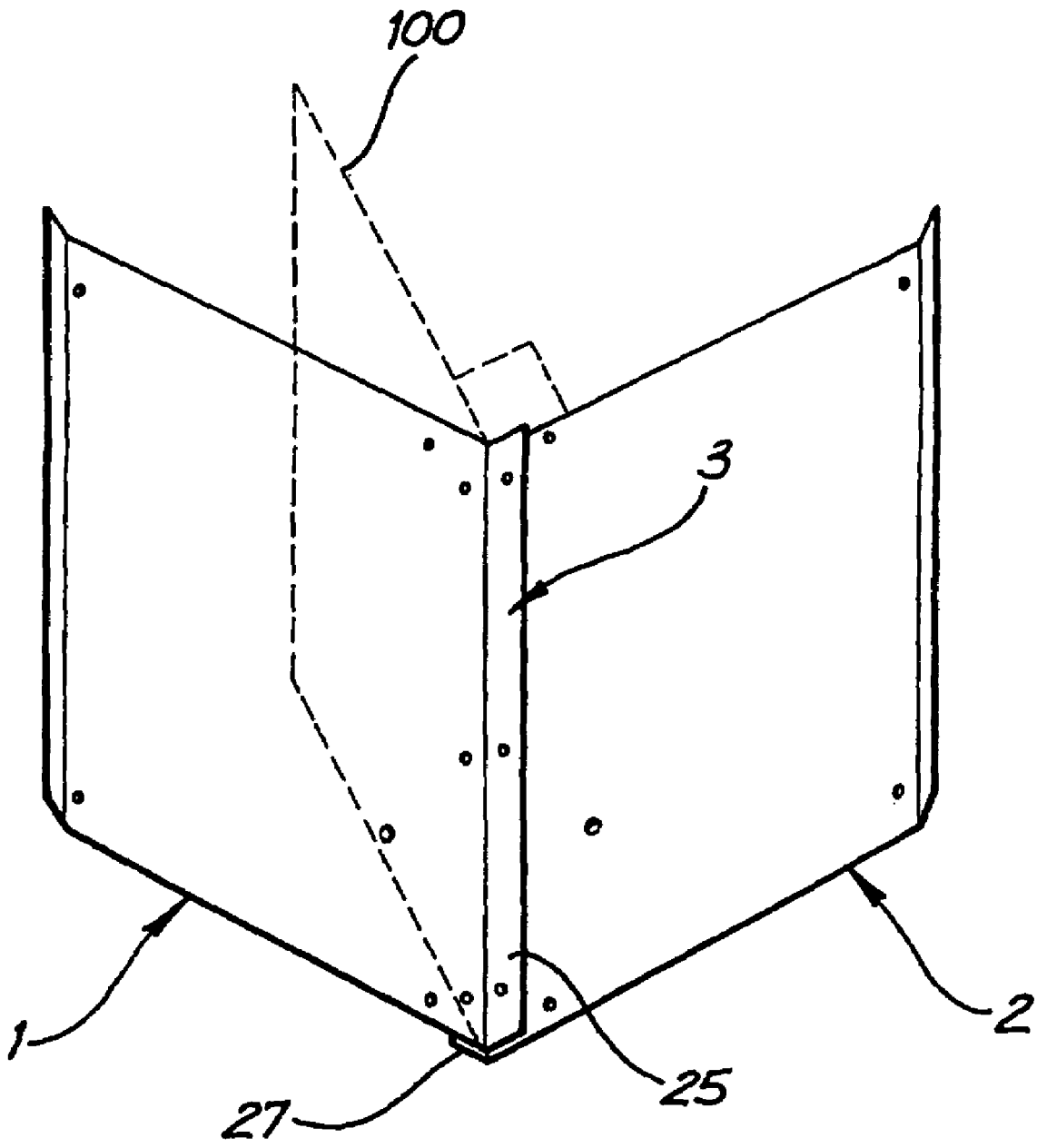

Referring to FIGS. 3 and 4 it can be seen how sheet members 1 and 2 are joined at an obtuse angle. A phantom plane 100 which is substantially perpendicular to the plane occupied by sheet member 2 is illustrated in FIG. 4. Thus in their unbiased condition, the sheet members 1 and 2 preferably make an obtuse angle of approximately 120°–140° (more preferably 130°).

Skirts 27 and 25 are overlapped and attached to the bodies of the sheet members 1 and 2 to create a reinforced joint about the newly created spine 3 as illustrated so that the members 1 and 2 and spine 3 resemble the pages of a book.

Figure 5:
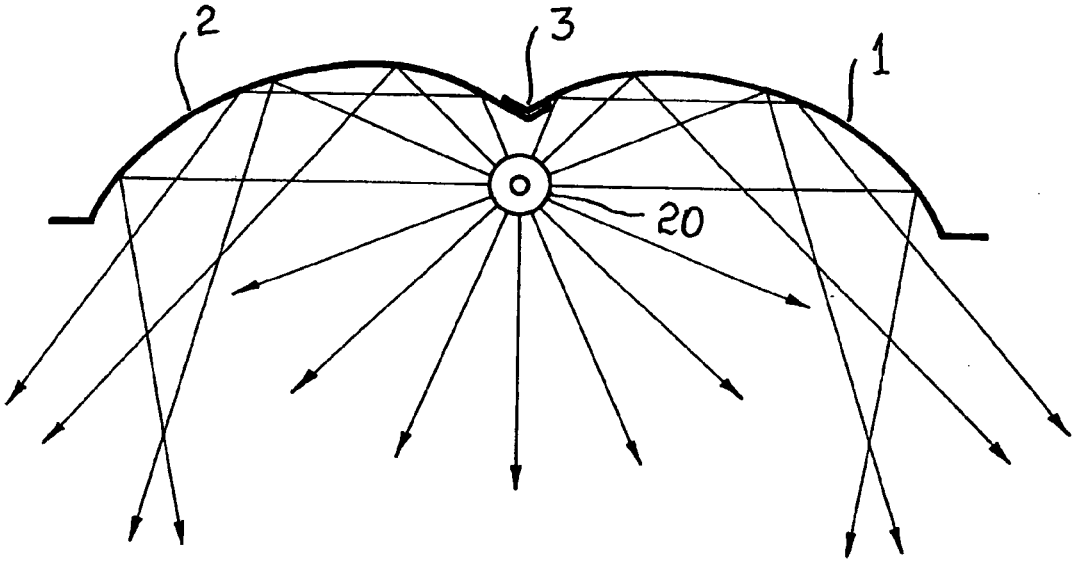
FIG. 5 is a schematic end view of the luminaire of FIG. 1 but without the heat shield.
Figure 7:
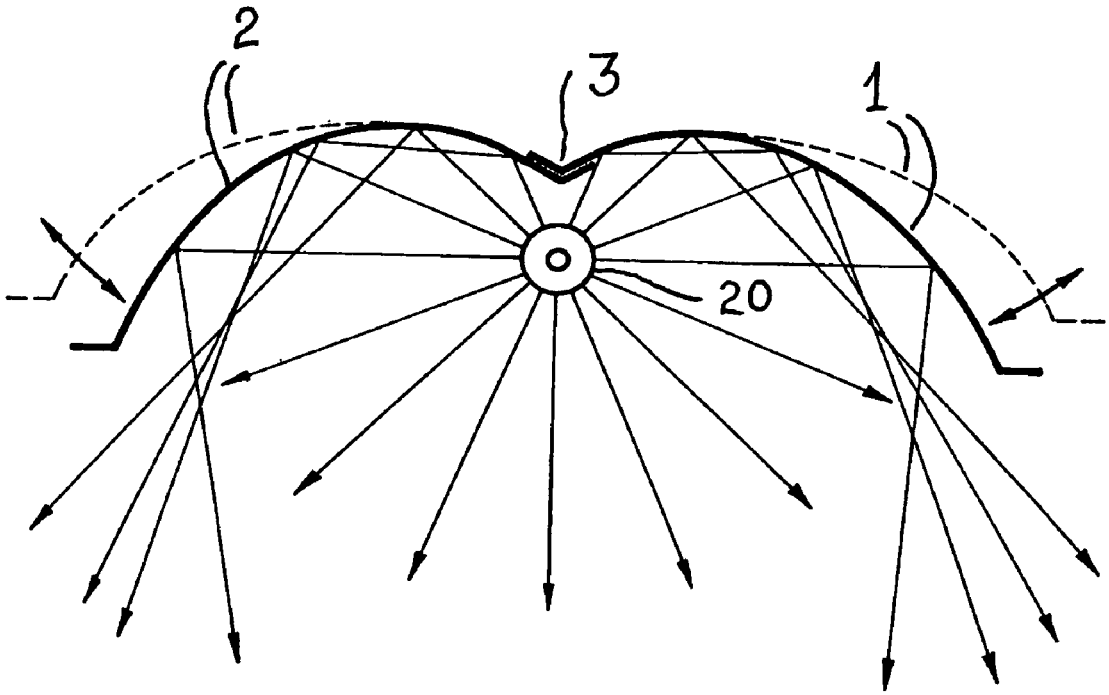
FIG. 7 is a view similar to FIG. 5 but showing how the reflector can be adjusted.

In FIG. 5 it will be seen that the lamp 20 emits rays in all directions. Those rays which are emitted upwardly strike the arched sheet members 1 and 2 and are then reflected downwardly. As illustrated in FIG. 7 by flexing the sheet members 1 and 2 to a greater, or a lesser, extent as indicated by the arrows in FIG. 7, the nature of the reflections can be changed so as to be more concentrated or less concentrated. An important point in this connection is that since the filament of the lamp 20 is located directly below the spine 3, no rays are reflected from the sheet members 1 and 2 back into the lamp 20. This assists in prolonging the operating life of the lamp 20.

Figure 6:
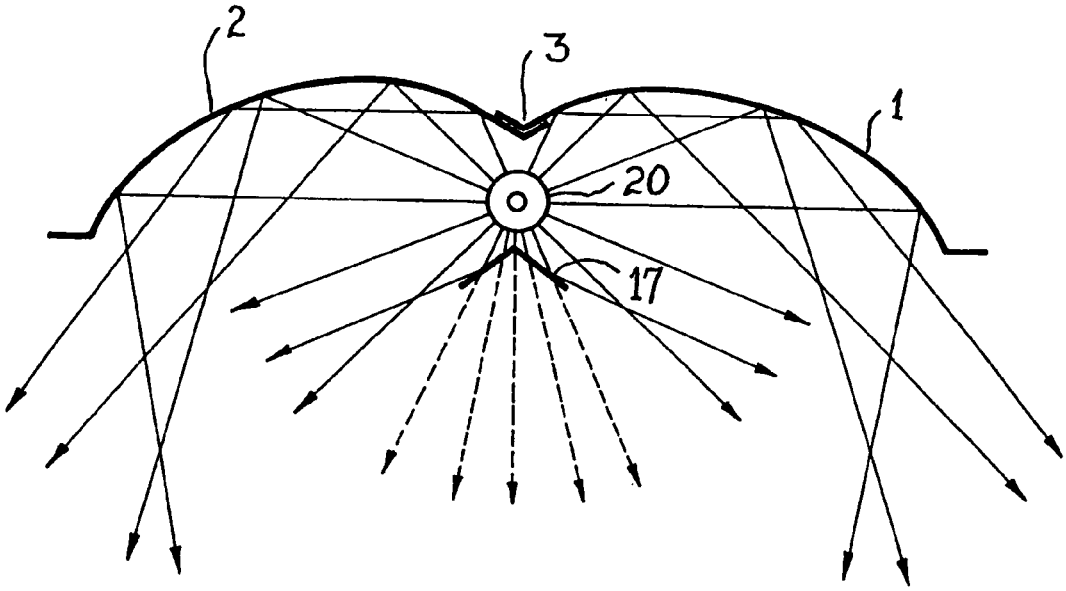
FIG. 6 is a view similar to FIG. 5 but with the heat shield.
Figure 6:
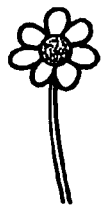

In FIG. 6, the effect of the heat shield 17 is illustrated. Some rays, those illustrated by dashed lines in FIG. 6, emanate from the lamp 20 and pass directly through one of the holes 30 in the heat shield and thus continue directly through the heat shield 17 without deviation. Those rays which do not directly strike a hole 30 are reflected by the heat shield 17 and because of the geometry are reflected downwardly and not upwardly into either the lamp 20 or so as to strike the sheet members 1, 2. As a consequence, there are no reflections from the heat shield 17 back into the lamp 20 which again prolongs lamp life. In addition, no rays are reflected twice (ie once off the heat shield 17 and then from the sheet members 1, 2). The absence of double reflections means that a high efficiency is able to be achieved.

The presence of the heat shield 17 means that flowers or other plants which are grown under artificial illumination provided by the lamp 20 do not suffer from is a "hot spot" directly below the lamp 20. The effect of the heat shield 17 together with the sheet members 1, 2 is to provide a more even and uniform degree of illumination over a relatively wide area below the luminaire.

By appropriate adjustment of the reflector device described above, many and varied desirable conditions of artificial illumination can be achieved. Hence, the previous need to employ more than one reflective device to efficiently service a range of discrete tasks is reduced or abolished.

It will be realized that the reflector device according to this invention is not restricted to the specific shape and construction of the resilient sheets shown in the example, but may use a reflector fashioned from one, two, or more pieces of suitable material of any suitable shape or size so long as the essential feature of being flexed back against a spine or axial crease to create an adjustable doubly arched configuration or other similar shape is achieved.

It will be understood to persons skilled in the art that variations and modifications to the invention will be possible. All such variations and modifications should be considered to fall with the scope of the invention as hereinbefore described and as hereinafter claimed.

The term "comprising" (and its grammatical variations) as used herein is used in the inclusive sense of "having" or "including" and not in the exclusive sense of "consisting only of".

What is claimed is:

1. A reflector device for a luminaire, said reflector device comprising a pair of resilient sheets positioned one to either side of a spine in the manner of the pages of a book, said sheets when in an unbiased condition lying substantially in two planes intersecting at an obtuse angle and extending from the spine to free edges, and when flexed and retained against the bias of their normal resilience having a doubly arched configuration of selectable curvature which forms a reflective surface, and at least one retainer connected between said free edges, said retainer being detachable from and reattachable to at least one of said free edges to adjust the distance between said free edges thereby to select the curvature of the reflective surface from a plurality of possible curvatures.

2. The device as claimed in claim 1 wherein said sheets are formed from a plurality of separate pieces which are joined together.

3. The device as claimed in claim 2 having two sheet members each of which is substantially rectangular and is provided with a skirt extending along one edge, each said skirt being bent out of the plane of said rectangle, and said sheets being joined together by overlapping said skirts.

4. The device as claimed in any of claims 2 wherein said sheets are joined by fasteners.

5. The device as claimed in claim 1 wherein said spine is substantially centrally located and said reflective surface is substantially symmetrical with respect to said spine.

6. The device as claimed in claim 1 wherein said retainer extends between opposite sides of said doubly arched configuration.

7. The device as claimed in claim 6 wherein said retainer is selected from the group consisting of chains, wires, filaments, strips, threaded rods or telescopic members.

8. The device as claimed in claim 1 wherein said pair of sheets are fabricated from one piece of material.

9. A luminaire comprising a lamp holder and the reflector device as claimed in claim 1.

10. The luminaire as claimed in claim 9 wherein said lamp holder is adjustably mounted to permit adjustment of the distance between said lamp holder and said reflector device.

11. The luminaire as claimed in claim 9 and including a heat shield positioned to a side of said lamp holder opposite to that on which said reflector device is positioned.

12. The luminaire as claimed in claim 11 wherein said heat shield has a substantially U-shaped or V-shaped configuration.

13. The luminaire as claimed in claim 12 wherein said heat shield is perforated.

14. A reflector device for a luminaire, said reflector device comprising a pair of resilient sheets positioned one to either side of a spine in the manner of the pages of a book, said sheets when in an unbiased condition lying substantially in two planes intersecting at an obtuse angle and when flexed and retained against the bias of their normal resilience having a doubly arched configuration which forms a reflective surface, said sheets being retained in said doubly arched configuration by a retainer which extends between opposite sides of said doubly arched configuration and is adjustable in length.

15. A luminaire having an adjustable reflector and an elongate light source to emit a beam of light of adjustable beam geometry, said reflector having a doubly arched configuration formed by two resilient wings located one to either side of a central region and arched into a substantially symmetrical m-shaped configuration having a longitudinally extending axis of symmetry and two concave reflective surfaces wherein said wings have substantially parallel outer extremities, said light source is arranged adjacent said concave surfaces and is both spaced apart from, and substantially parallel to, said axis of symmetry whereby light from said light source is incident on each of said concave surfaces substantially equally, and whereby the curvature of said concave reflective surfaces is simultaneously and equally adjustable by adjusting the distance between said outer extremities and said luminaire further comprising at least one elongate retainer each of which extends between the outer extremity of one wing to the outer extremity of the other wing to retain said concave reflective surfaces at a predetermined selected one of a plurality of possible curvatures each of which results in a different geometry of the beam of light emitted from said luminaire.

16. The luminaire as claimed in claim 15 wherein said wings are formed from two separate pieces, and said central region comprises a spine formed by overlapping edges of said wings.

17. The luminaire as claimed in claim 15 and having an elongate perforated heat shield of substantially U-shaped or V-shaped transverse cross-sectional shape, said heat shield being positioned spaced apart from, and substantially parallel to said light source, with said light source being between said concave reflective surfaces and said heat shield whereby light from said light source incident on said heat shield is not reflected back towards said light source.

18. A method of adjusting the radiant intensity of a luminaire having a resilient doubly-arched reflective surface formed from a pair of sheets positioned one to either side of a spine in the manner of the pages of a book, the sheets when in an unbiased condition lying substantially in two planes intersecting at an angle and extending from the spine to free edges, said method comprising the steps of flexing said sheets against the bias of their normal resilience creating said doubly-arched configuration wherein said free edges are spaced from to one another, and connecting a retainer between said free edges which is detachable from and reattachable to at least one of said free edges to adjust the spacing of said free edges and thus the degree of flexure of said sheets thereby to select the curvature of said doubly-arched reflective surface.

19. The method as claimed in claim 18 including the further step of positioning a lamp holder to be generally aligned with said spine and adjusting the distance between said lamp holder and spine.

20. The method as claimed in claim 19 including the further step of locating a heat shield to that side of said lamp holder opposite to that on which said reflective surface is positioned.

21. The method as claimed in claim 20 including the further step of forming said heat shield with a substantially U-shaped or V-shaped configuration.

22. The method as claimed in claim 21 including the further step of forming a plurality of perforations in said heat shield.

23. A method of making a reflector device for a luminaire comprising the steps of forming a pair of flat, flexible, resilient reflective sheets which extend away from a rigid central spine to free edges and which define an obtuse angle, flexing the sheets away from the spine so as to widen said angle and form a pair of arched reflective surfaces on opposite sides of the spine which extend from the spine to said free edges, and connecting the free edges together by a retainer which is detachable from and then reattachable to at least one of said free edges so as to maintain a selected one of a plurality of possible distances between them.

24. The method defined in claim 23 wherein said sheets are formed from a single reflective blank which is bent to form said spine.

25. The method defined in claim 23 wherein said sheets are formed by joining together a pair of separate reflective parts along a boundary that forms said spine.

26. A method of making a reflector device for a luminaire comprising the steps of forming a pair of flat, flexible, resilient reflective sheets which extend away from a rigid central spine to free edges and which define an obtuse angle, flexing the sheets away from the spine so as to widen said angle and form a pair of arched reflective surfaces on opposite sides of the spine which extend from the spine to said free edges, connecting the free edges together and adjusting the distance between said free edges so as to change the curvature of said reflective surfaces.

* * * * *